US007957674B2

(12) United States Patent
Yamaguchi

(10) Patent No.: US 7,957,674 B2
(45) Date of Patent: Jun. 7, 2011

(54) IMAGE FORMING DEVICE WHOSE UPPER COVER IS PROVIDED WITH DISCHARGE ROLLER AND PINCH ROLLER

(75) Inventor: Takuya Yamaguchi, Toyokawa (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 12/536,027

(22) Filed: Aug. 5, 2009

(65) Prior Publication Data

US 2010/0054808 A1 Mar. 4, 2010

(30) Foreign Application Priority Data

Aug. 28, 2008 (JP) ..... 2008-219378

(51) Int. Cl.
*G03G 15/00* (2006.01)

(52) U.S. Cl. ..... 399/124; 399/21

(58) Field of Classification Search ..... 399/124, 399/125, 405, 21
See application file for complete search history.

(56) References Cited

U.S. PATENT DOCUMENTS

| | | | | |
|---|---|---|---|---|
| 5,140,369 | A * | 8/1992 | Haneda et al. | 399/112 |
| 5,787,326 | A * | 7/1998 | Ogawa et al. | 399/124 |
| 7,209,681 | B2 | 4/2007 | Yamada et al. | 399/119 |
| 7,227,562 | B2 | 6/2007 | Asuwa et al. | 347/138 |
| 2004/0085431 | A1 | 5/2004 | Asuwa et al. | 347/129 |
| 2004/0091290 | A1 | 5/2004 | Yamada et al. | 399/284 |
| 2005/0163533 | A1* | 7/2005 | Hashimoto et al. | 399/124 |
| 2006/0222401 | A1 | 10/2006 | Kamimura | 399/101 |
| 2007/0269246 | A1 | 11/2007 | Tomatsu et al. | 399/401 |
| 2008/0063430 | A1* | 3/2008 | Nobuoka et al. | 399/124 |
| 2010/0003050 | A1* | 1/2010 | Minaminaka | 399/114 |

FOREIGN PATENT DOCUMENTS

| | | |
|---|---|---|
| JP | 5-208773 | 8/1993 |
| JP | H05-204214 | 8/1993 |
| JP | 6-183628 | 7/1994 |
| JP | H07-117908 | 5/1995 |
| JP | 8-175733 | 7/1996 |
| JP | 9-188458 | 7/1997 |
| JP | 2000-26005 | 1/2000 |
| JP | 2000-56530 | 2/2000 |
| JP | 2002-096957 | 4/2002 |
| JP | 2002-145507 | 5/2002 |
| JP | 2004-206071 | 7/2004 |
| JP | 2004-334247 | 11/2004 |
| JP | 2006-276447 | 10/2006 |
| JP | 2007-176636 | 7/2007 |
| JP | 2007-331845 | 12/2007 |

OTHER PUBLICATIONS

Machine translation of JP 05-204214 A dated Sep. 24, 2010.* Japanese Office Action with English translation dated Jun. 1, 2010.

* cited by examiner

*Primary Examiner* — Sophia S Chen
(74) *Attorney, Agent, or Firm* — Scully, Scott, Murphy & Presser, P.C.

(57) ABSTRACT

In order to facilitate removal of jammed sheets in an image forming device placed at a low place, there is provided an image forming device including a main body formed with an upper opening; an image forming unit that forms images on recording medium, and an upper cover pivotably movably supported to the main body for covering the upper opening. The main body accommodates the image forming unit. The upper cover includes a discharge roller and a pinch roller pressed against the discharge roller. The discharge roller discharges the recording medium conveyed from the image forming unit outside the main body of the image forming device in cooperation with the pinch roller.

10 Claims, 7 Drawing Sheets

IMAGE FORMING DEVICE WHOSE UPPER COVER IS PROVIDED WITH DISCHARGE ROLLER AND PINCH ROLLER

CROSS REFERENCE TO RELATED APPLICATION

This application claims priority from Japanese Patent Application No. 2008-219378 filed Aug. 28, 2008. The entire content of the priority application is hereby incorporated by reference.

TECHNICAL FIELD

The present invention relates to an image forming device and more particularly to a discharge roller and a pinch roller for discharging recording sheets outside of a main body of the image forming device.

BACKGROUND

A conventional well-known image forming device includes a main body formed with an upper opening, an upper cover that covers the upper opening, a discharge roller that discharges sheets of paper onto an upper surface of the upper cover, and a pinch roller that is pressed against the discharge roller. The main body is formed of a protruding portion protruding upward of the upper cover. The discharge roller and the pinch roller are disposed within the protruding portion and covered with an upper wall provided in the protruding portion.

In the above-described conventional image forming device, however, if a paper jam occurs around the discharge roller when the main body is placed at a low place, a user needs to bend over to see under the upper wall of the protruding portion. Hence, cumbersome efforts are sometimes required at the time of addressing paper jams.

SUMMARY

In view of the forgoing, it is an object of the present invention to provide an image forming device that facilitates removal of jammed sheets even when placed at a low place.

To achieve the above and other object, the present invention provides an image forming device that includes a main body formed with an upper opening; an image forming unit that forms images on recording medium, the main body accommodating the image forming unit; and an upper cover pivotably movably supported to the main body for covering the upper opening. The upper cover includes a discharge roller and a pinch roller pressed against the discharge roller. The discharge roller discharges the recording medium conveyed from the image forming unit outside the main body of the image forming device in cooperation with the pinch roller.

DETAILED DESCRIPTION

Figure 1:
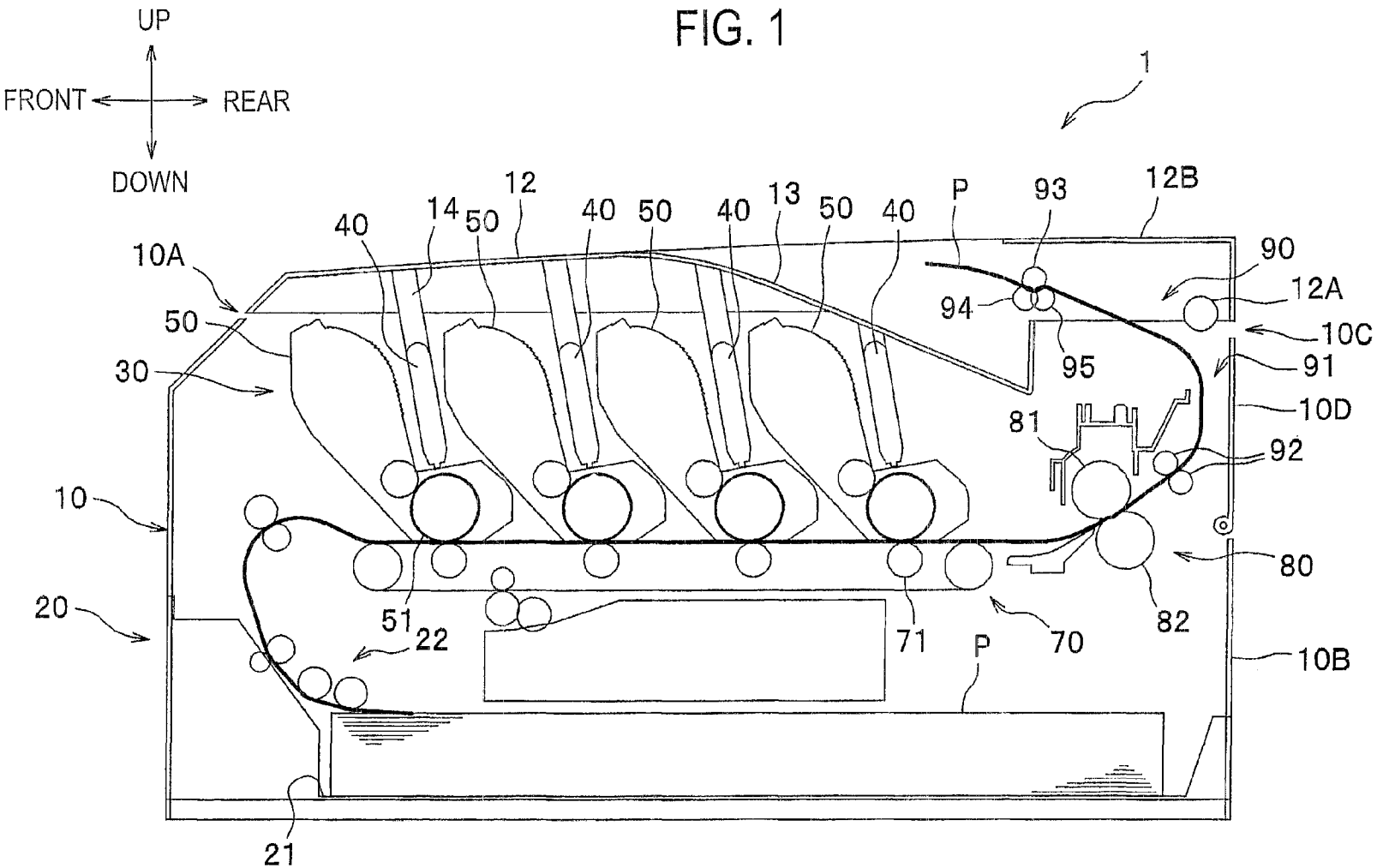
FIG. 1 is a cross-sectional view showing an entire configuration of a color printer according to an embodiment of the present invention.

Hereinafter an embodiment of the present invention will be described in detail with reference to FIGS. 1 through 7. Note that, in the following description, orientations will be referred to assuming that a color printer 1 according to the present embodiment is disposed in an orientation in which it is intended to be used. That is, the left side of FIG. 1 will be designated as a "front (near) side", the right side of FIG. 1 as a "rear (far) side", the far side as a "left side", and the near side as a "right side". Also, an up-to-down direction in FIG. 1 will be referred to as a "vertical direction".

First, an entire configuration of the color printer 1 will be described while referring to FIG. 1. The color printer 1, an example of electrophotographic color printers, includes a main body 10, a sheet feeding unit 20 that supplies sheets P (an example of recording media), an image forming unit 30 that forms images on the supplied sheets P, and a discharging unit 90 that discharges the sheets P on which images have been formed.

The main body 10 is formed with an upper opening 10A. A hinge 12A is provided at a position rearward and upward in the main body 10. An upper cover 12 is pivotably connected to the main body 10 so that the upper cover 12 can pivotably move in the vertical direction about the hinge 12A to expose and cover the upper opening 10A. The upper cover 12 has an upper surface formed with a discharge tray 13 that receives the sheets P discharged out of the main body 10. The upper cover 12 has a bottom surface provided with a plurality of LED installation members 14 that supports a plurality of LED units 40 (to be described later). A rear wall 10B is provided at the rear end of the main body 10 (at a side on which the hinge 12 is disposed). The rear side wall 10B has an opening 10C for exposing a sheet discharge path 91 (to be described later) and a rear cover 10D for covering the opening 10C.

The sheet feeding unit 20 is disposed in a lower portion of the main body 10. The sheet feeding unit 20 includes a sheet tray 21 that accommodates the sheets P and a sheet supplying mechanism 22 that coveys the sheets P from the sheet tray 21 to the image forming unit 30. In the sheet feeding unit 20, the sheets P accommodated in the sheet tray 20 are separated one by one and supplied to the image forming unit 30 by the sheet supplying mechanism 22.

The image forming unit 30 includes four LED units 40, four process cartridges 50, a transferring unit 70 and a fixing unit 80.

Each LED unit 40 includes a plurality of LEDs and exposes corresponding photosensitive drum 51 (to be described later) to light. The process cartridges 50 are juxtaposed in a front-to-rear direction between the upper cover 12 and the sheet feeding unit 20. Each process cartridge 50 includes a photosensitive drum 51, a charger (not shown), a developing roller and a toner accommodation chamber. The developing roller and the toner accommodation chamber are shown in the drawings but not designated with reference numerals.

In the process cartridges 50, surfaces of photosensitive drums 51 are charged by respective chargers, and then exposed by the corresponding LED units 40. As a result, exposed areas are to have lower potentials, thereby forming latent electrostatic images based on image data on each photosensitive unit 51. Toner is then supplied to the latent electrostatic images, and toner images are thus carried on each surface of the photosensitive drums 51.

The transferring unit 70 is disposed between the sheet feeding unit 20 and each process cartridge 50. The transferring unit 70 includes transfer rollers 71, a drive roller, a follow roller and a conveyer belt. Reference numerals of the drive roller, follow roller and the conveyer belt are omitted in the drawings. In the transferring unit 70, while each of the sheets P conveyed by the conveyer belt passes between each photosensitive drum 51 and the corresponding transfer roller 71, toner images borne on each photosensitive drum 51 are attracted to the corresponding transfer roller 71 and transferred onto the sheet P.

The fixing unit 80 is disposed rearward of the process cartridges 50 and the transferring unit 70. The fixing unit 80 includes a heat roller 81 and a pressure roller 82 that applies pressure to the heat roller 81. In the fixing unit 80, the heat roller 81 and the pressure roller 82 convey each sheet P with the sheet P nipped therebetween, thereby thermally fixing toner images on each sheet P.

The discharging unit 90 includes conveyer rollers 92, discharge rollers 93 and pairs of pinch rollers 94 and 95. The conveyer rollers 92 convey the sheets P. The discharge rollers 93 discharge the sheets P outside of the main body 10 in cooperation with the pairs of pinch rollers 94 and 95. The pinch rollers 94 and 95 are pressed against the discharge roller 93. A sheet discharge path 91 is formed in the discharging unit 90, extending from an exit of the fixing unit 80 first toward diagonally upward and rearward, and then toward diagonally upward and forward. In the discharging unit 90, the sheets P are discharged out of the main body 10 by the discharge rollers 93 and the pinch rollers 94 and 95, and finally accumulated in the discharge tray 13.

Next, detailed configuration around the discharge rollers 93 will be described with reference to FIGS. 2A to 6B. Note that, in FIGS. 2A and 2B, only two gears are shown with gear teeth for the sake of simplifying explanation. Other gears are shown in pitch circles.

As shown in FIG. 1, the discharge rollers 93 and the pairs of pinch rollers 94 and 95 are rotatably provided in the upper cover 12. Specifically, an upper wall 12B provided in the upper cover 12 covers the discharge rollers 93 and the pinch rollers 94 and 95 so that a user cannot access to the discharge rollers 93 and the pinch rollers 94 and 95 when the upper cover 12 is closed.

Figure 2A:
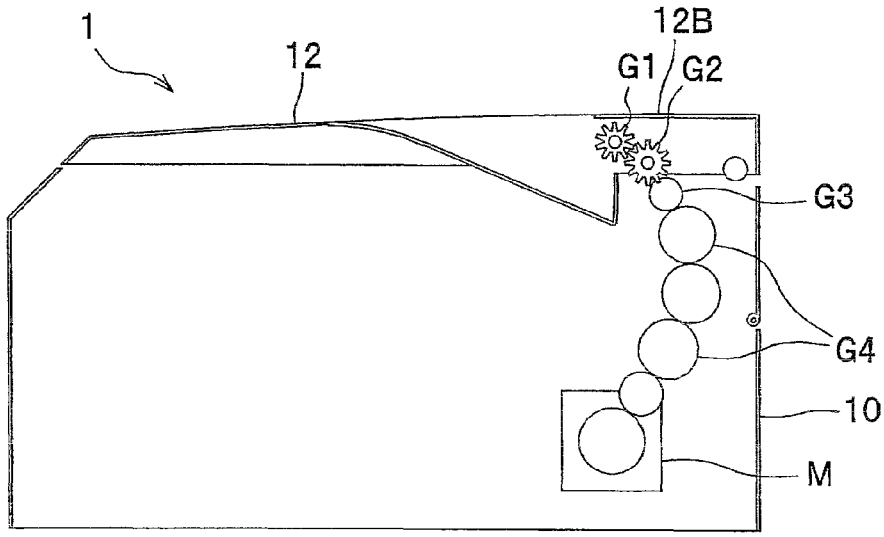
FIG. 2A is a cross-sectional view showing a gear train that serves to transmit a driving force to a discharge roller.

As shown in FIG. 2A, a drive gear G1 is rotatably disposed next to the discharge roller 93 so that the drive gear G1 and the discharge roller 93 can rotate in interlocking relation with each other. The drive gear G1 thus transmits driving force to the discharge roller 93. A cover gear G2 is rotatably supported to the upper cover 12, while a main body gear G3 is rotatably supported to the main body 10. The drive gear G1 meshingly engages the cover gear G2, and the cover gear G2 in turn meshingly engages the main body gear G3. In this way, the drive gear G1 meshingly engages the main body gear G3 indirectly via the upper cover gear G2.

As shown in FIG. 2A, the main body gear G3 is connected to a motor M, a drive source, via a plurality of intermediate gears G4. When the upper cover 12 is closed, the cover gear G2 and the main body gear G3 are meshingly engaged with each other. Accordingly, driving force from the motor M is transmitted to the discharge roller 93, thereby driving the discharge roller 93 to rotate. At this time, the pinch rollers 94 and 95, which are in pressure contact with the discharge roller 93, are rotated following the rotation of the discharge roller 93.

Figure 2B:
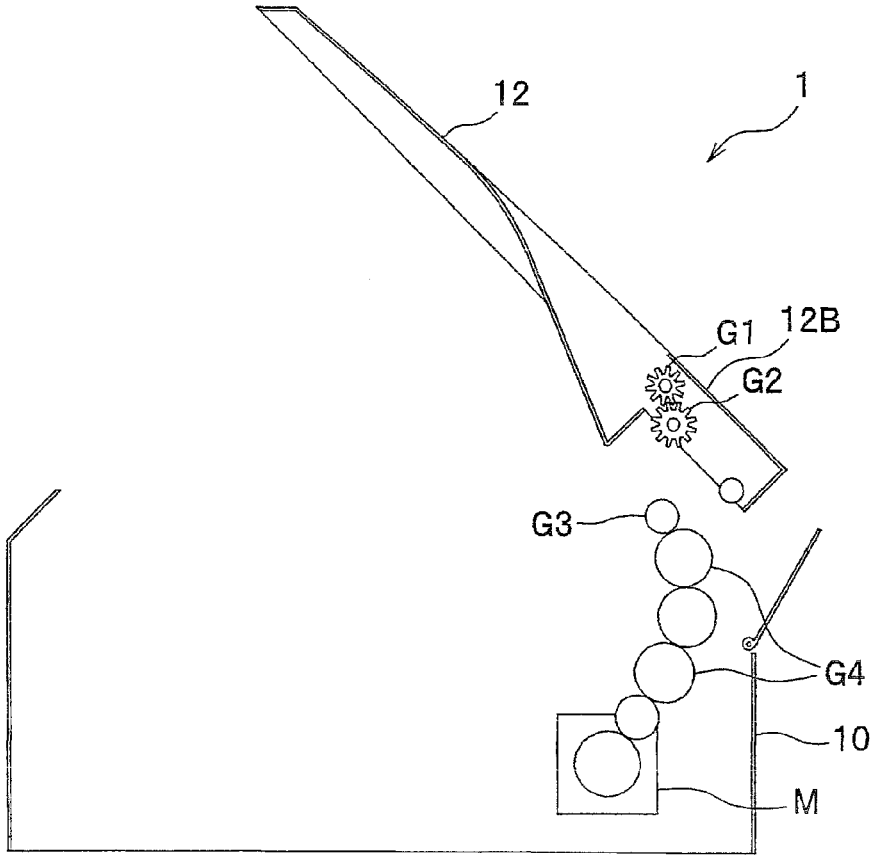
FIG. 2B is a cross-sectional view showing the gear train when an upper cover is opened.

In contrast, when the upper cover 12 is opened as shown in FIG. 2B, the cover gear G2 and the main body gear G3 are disengaged from each other. That is, rotations of the main body gear G3 are not transmitted to the drive gear G1. In this way, the driving force from the motor M is not transmitted to the cover gear G2 when the upper cover 12 is opened. In this state, no load is imposed on the discharge roller 93, and the pinch rollers 94 and 95, and thus a user can manually rotate the discharge roller 93 and the pinch rollers 94 and 95.

Figure 3:
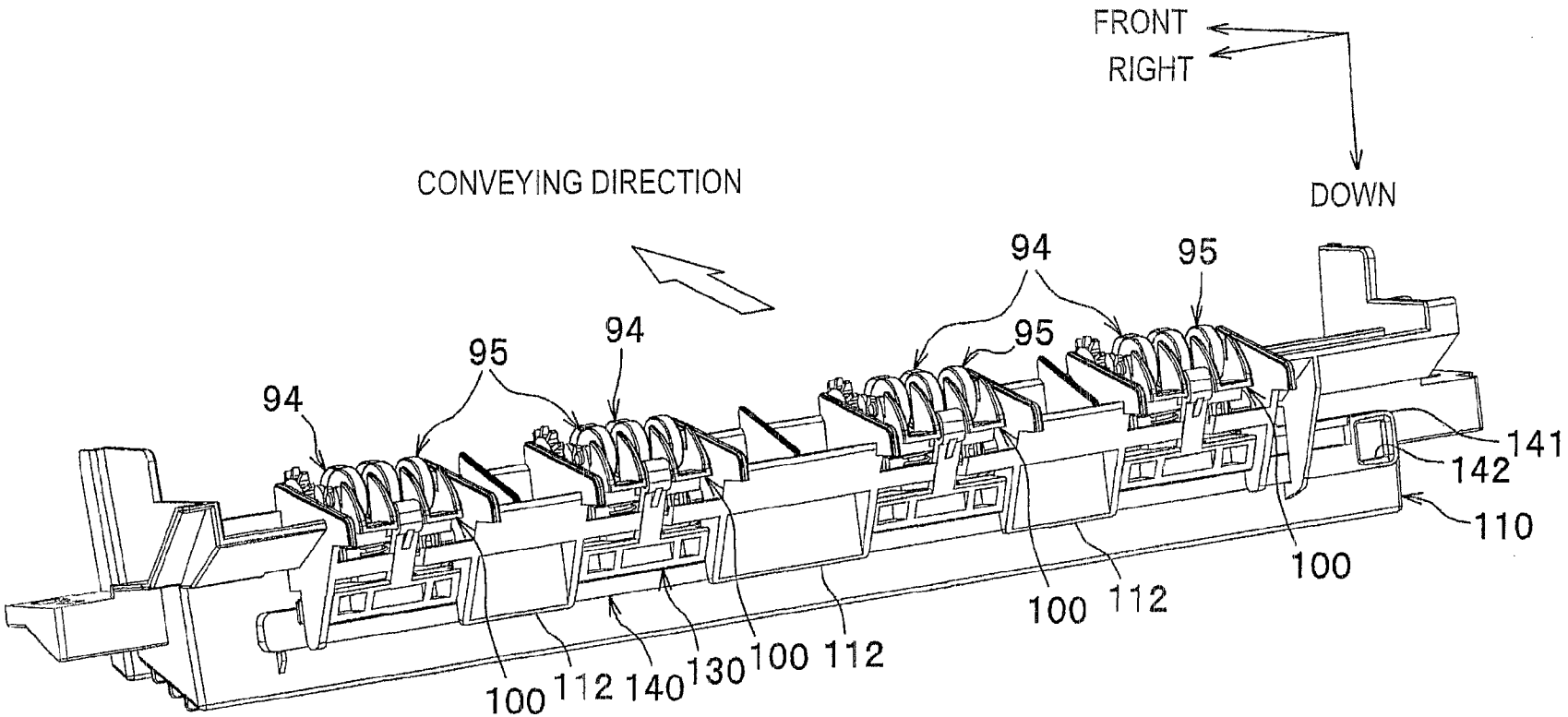
FIG. 3 is a perspective view showing a configuration around pinch rollers.
Figure 4:
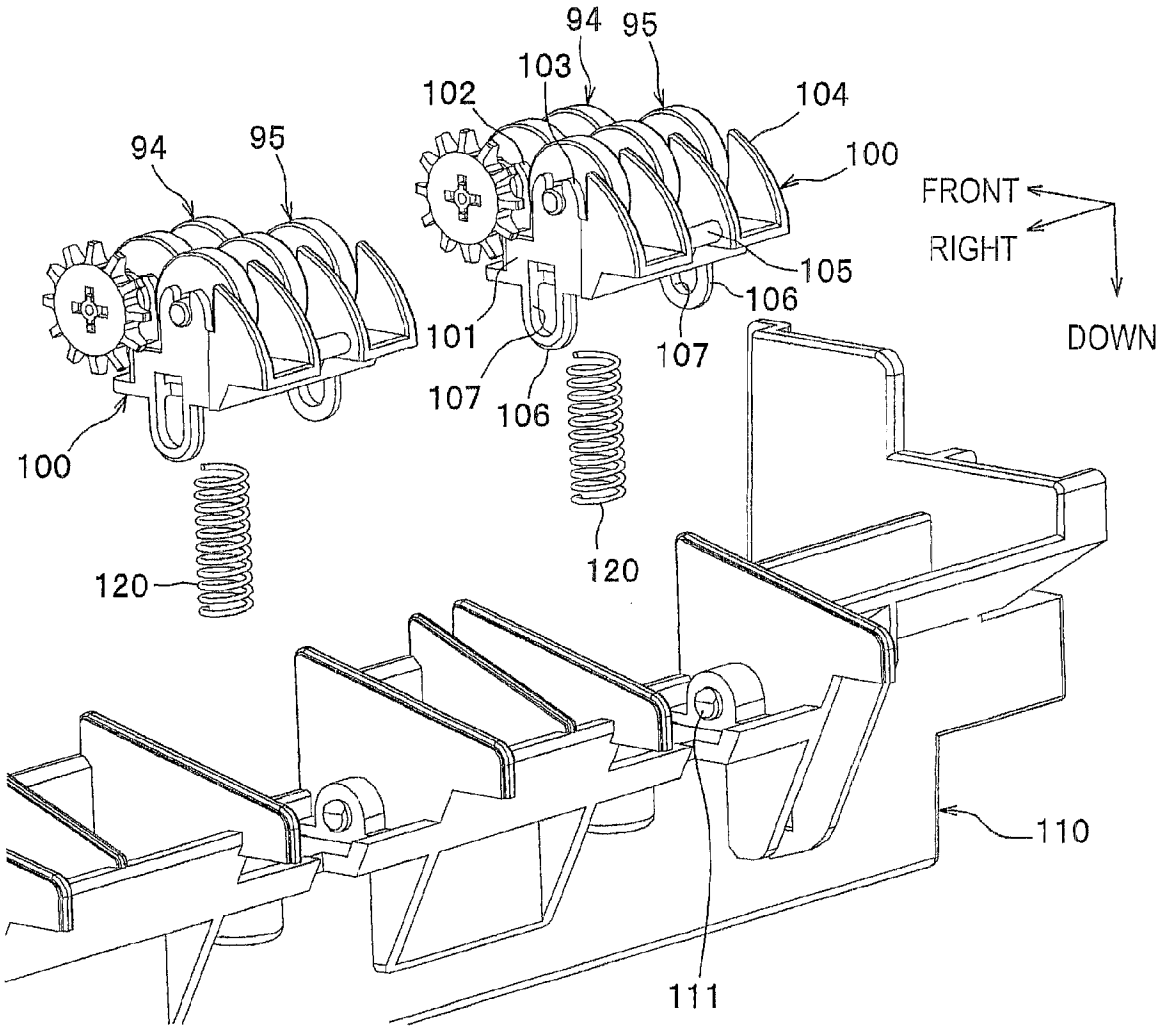
FIG. 4 is an exploded perspective view showing a detailed configuration of a supporting member.

As shown in FIG. 3, four pairs of pinch rollers 94 and 95 are arranged at intervals in the left-to-right direction (widthwise direction of the sheet P) or in a direction orthogonal to a conveying direction. In each pair of pinch rollers 94 and 95, the pinch roller 95 is disposed upstream in the conveying direction and the pinch roller 94 downstream in the conveying direction. As best shown in FIG. 4, each pinch roller 94 is made up of two roller portions formed coaxially and integrally. Each pinch roller 95 is made up of three roller portions formed coaxially and integrally. Each pair of pinch rollers 94 and 95 is rotatably supported to each supporting member 100 (to be described next).

Each supporting member 100 includes a base 101, two downstream-side bearings 102 (only a counterpart thereof appears in FIG. 4), two upstream-side bearings 103 (only a counterpart thereof appears in FIG. 4), four guides 104, a pin 105 and two flanges 106.

Each downstream-side bearing 102 protrudes upward from each widthwise end of the base 101. The downstream-side bearings 102 rotatably support the pinch roller 94. Each upstream-side bearing 103 is disposed adjacent to and rearward of the corresponding downstream-side bearing 102 (i.e., upstream in the conveying direction). The upstream-side bearings 103 rotatably support the pinch roller 95.

Four guides 104 are disposed rearward of the upstream-side bearings 103 (upstream in the conveying direction) and arranged at intervals in the left-to-right direction. The four guides 104 guide the sheet P toward a position between the discharge roller 93 and the pair of the pinch rollers 94 and 95. The pin 105 is formed between the two internally-located guides 104 and has an axis extending in a direction parallel to the left-to-right direction.

Each flange 106 protrudes downward from each widthwise end of the base 101. Each flange 106 is formed with a vertically elongated hole 107.

A sub frame 110 is provided in the main body 10. The sub frame 110 is an elongated member extending in left-to-right direction, and has four supporting frame receiving portions defined by two horizontally spaced-apart walls. Each receiving portion is configured to receive the supporting member 100, in which two engaging shafts 111 project horizontally inwardly from the walls to be in confronting relation with each other. The engaging shafts 111 are engageable with corresponding elongated holes 107 of the supporting member 100, allowing the supporting member 100 to pivotally move about the engaging shafts 111.

A coil spring 120 member interposed between the supporting member 100 and each of the four receiving portions. The coil spring 120 biases the supporting member 100 upward toward the discharge roller 93. As such, the supporting member is movable in a substantially vertical direction as well as pivotably movable about the engaging shafts 111.

Figure 5:
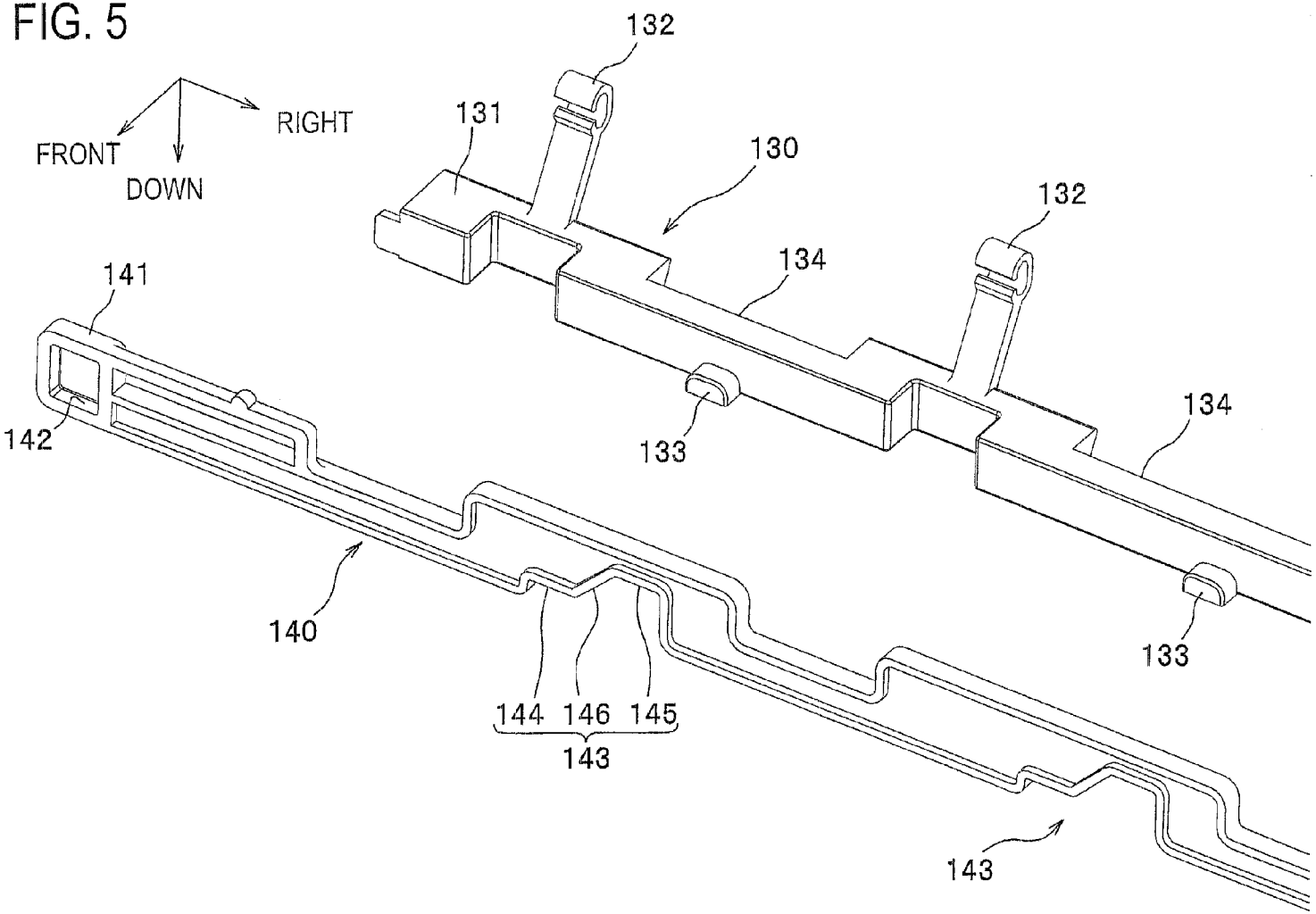
FIG. 5 is an exploded perspective view showing detailed configurations of a connection member and an operation member.

The sub frame 110 has a rear surface on which a connection member 130 and an operation member 140 are provided. As shown in FIG. 5, the connection member 130 includes a beam 131, four hooks 132 and three protrusions 133 (Note that, only two of the four hooks 132 are illustrated in FIG. 5. Likewise, only two of the three protrusions 133 are depicted in FIG. 5). The beam 131 is an elongated shape extending in the left-to-right direction. Each hook 132 extends diagonally upward and rearward from a prescribed position of the beam 131. Each protrusion 133 protrudes forward from a front surface of the beam 131.

The beam 131 has a rear surface formed with three recesses 134. Specifically, each recess 134 is formed between two adjacent hooks 132. As shown in FIG. 3, walls 112 are formed on the rear surface of the sub frame 110. Each wall 131 is designed to be slid and coupled to the recess 134 so that the beam 131 can move in the vertical direction relative to the sub frame 110.

Each hook 132 is formed with a top end portion having a substantially C-shaped cross-section. The top end portion engages the pin 105 so as to be pivotably movable about the pin 105.

Each protrusion 133 has an upper surface whose corners in the left-to-right direction are rounded off. Each upper surface of the protrusions 133 is pressed by a corresponding cam groove 143 formed in the operation member 140 (to be described later).

The operation member 140 is of elongated-shape, extending in the left-to-right direction. The operation member 140 is arranged adjacent to and forward of the connection member 130. The operation member 140 has a left-side end 141 formed with a rectangular opening 142 so that a user may put his finger in the opening 142 to move the operation member 140. As shown in FIG. 3, the left-side end 141 is configured to protrude outward in the left-to-right direction so that the left-side end 141 can come leftward of the four supporting members 100.

As shown in FIG. 5, the operation member 140 is formed with three cam grooves 143 corresponding to the three protrusions 133 for engagement with each other (only two of the cam grooves 143 are shown in FIG. 5). Each cam groove 143 is configured of a first groove 144, a second groove 145 and a sloped portion 146. The first groove 144 has a height shorter than the second groove 145 with respect to the bottom surface of the operation member 140. The sloped portion 146 diagonally connects the first groove 144 and the second groove 145. Here, the cam grooves 143 constitute a cam mechanism together with the protrusions 133.

Figure 6B:
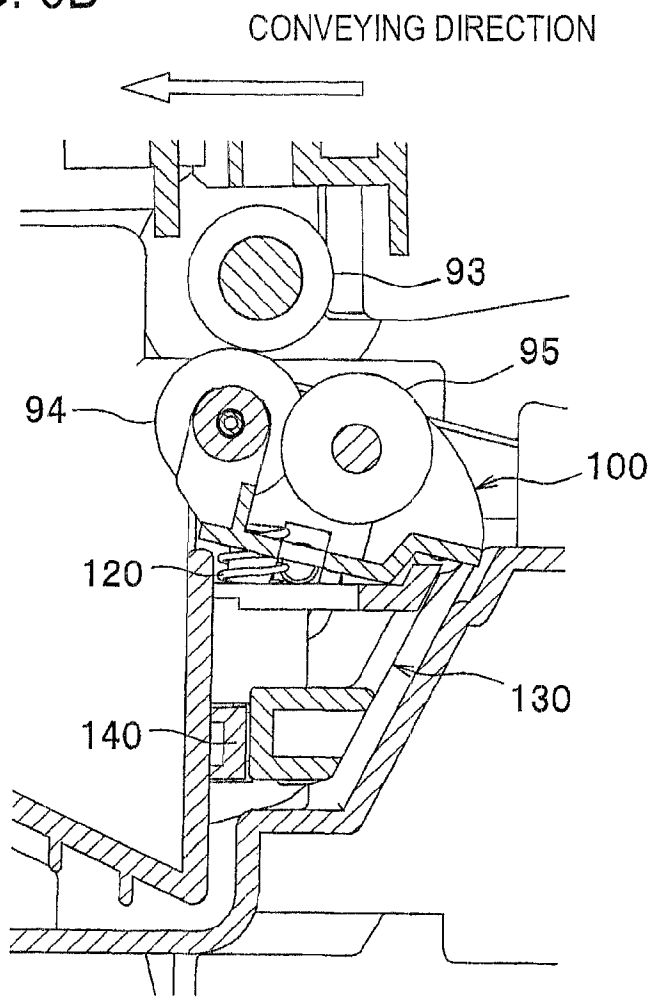
FIG. 6B is an enlarged cross-sectional view illustrating a state where one of the pinch rollers located upstream in a conveying direction is spaced away from the discharge roller.
Figure 6A:
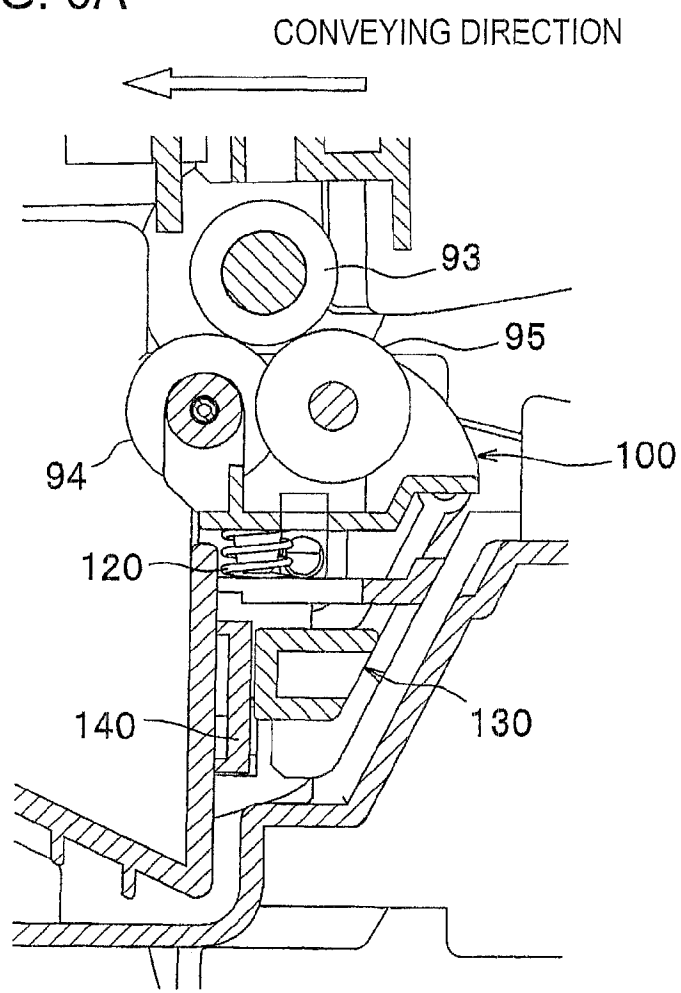
FIG. 6A is an enlarged cross-sectional view illustrating a state where the pair of pinch rollers is pressed against the discharge roller.

Assume that the protrusion 133 of the connection member 130 is initially located within the second groove 145 of the operation member 140. In this state, if a user pushes the operation member 140 rightward, the sloped portion 146 pushes the protrusion 133 downward, thereby enabling the connection member 130 to move downward. Simultaneously, each hook 132 pulls the corresponding pin 105 of the supporting member 100 downward against the biasing force of the coil spring 120. As a result, each supporting member 100 pivotally moves about the engaging shafts 111, thereby separating the pinch roller 95 from the discharge roller 93 as shown in FIGS. 6A and 6B. When the pinch roller 95 is kept away from the discharge roller 93, the protrusion 133 is in engagement with the first groove 144.

In other words, rightward force imparted on the operation member 140 is converted to force to move the pinch roller 95 from a press-contact position (FIG. 6A) to a separation position (FIG. 6B) due to the engagement between the protrusion 133 and the sloped portion 146, and is then transmitted to each supporting member 100. Note that, the "press-contact position" refers to a position where the pinch roller 95 is pressed against the discharge roller 93, while the "separation position" refers to a position where the pinch roller 95 is kept away from the discharge roller 93.

When a user pulls the operation member 140 leftward and moves the operation member 140 back to the initial position, the pinch roller 95 comes back to the press-contact position from the separation position because of the biasing force of the coil spring 120. Simultaneously, the protrusions 133 of the connection member 130 is prompted to return within the second groove 145 of the operation member 140 from the first groove 144 via the sloped portion 146. In this way, with the above-described cam mechanism, the pinch roller 95 is allowed to switch between the press-contact position and the separation position in accordance with manipulation of the operation member 140.

Next, a description will be given on how to settle a paper jam when the color printer 1 is placed at a low place.

Figure 7:
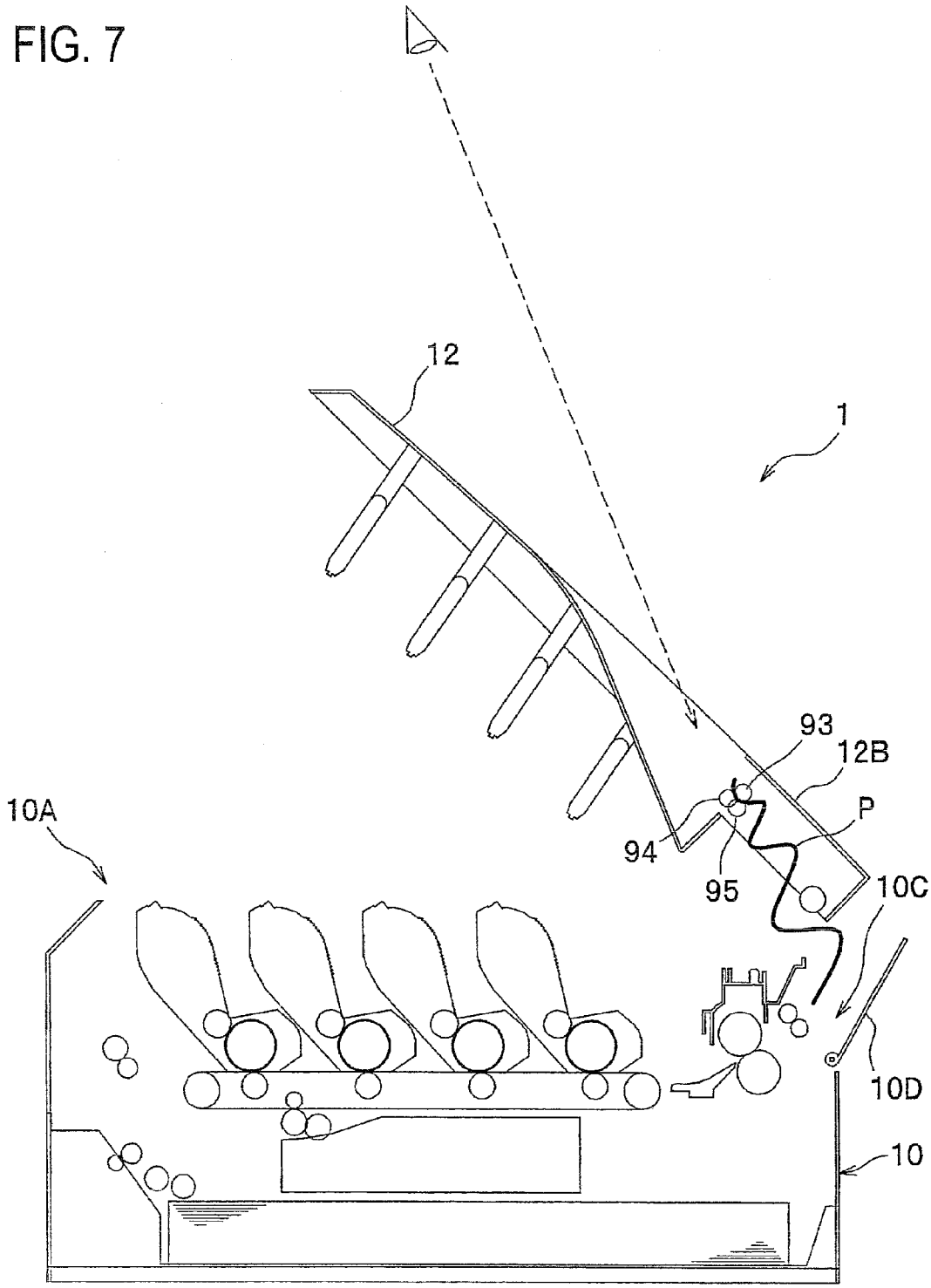
FIG. 7 is a cross-sectional view showing a state of the color printer at the time of coping with a paper jam.

As shown in FIG. 7, when a paper jam occurs at an area close to the discharge roller 93, a user first opens the upper cover 12. The discharge roller 93, which was originally covered with the upper wall 12B, is thus exposed and is brought closer to the user's eyes. That is, there is no need for a user to kneel down to look into the area around the discharge roller 93. The upper cover 12 can be maintained at a desired position where the user can have a clear vision of the discharge roller 93.

Subsequently, the user can pinch the paper P jammed around the discharge roller 93 and pull out the same with a hand free from the upper cover 12. At this time, the cover gear G2 and the main body gear G3 are disengaged from each other since the upper cover 12 has been opened, as described earlier (see FIG. 2B). Therefore, removing the jammed paper P requires less strength, facilitating settlement of paper jams by the user.

Moreover, at this time, if the user pushes the operation member 140 to the right, the pinch roller 95 is allowed to be separated from the discharge roller 93, as shown in FIG. 6B. Hence, a smaller load is applied to the paper P, requiring still less force for the user to pull out the paper P. Removal of the jammed paper P is therefore further facilitated.

Further, if the rear cover 10D of the main body 10 is opened in this state, the trailing edge of the jammed paper P can be exposed outside, which enables the user to remove the paper P jammed around the discharge roller 93 from the rear of the color printer 1.

According to the above-described embodiment of the present invention, the discharge roller 93 and the pinch rollers 94 and 95 are provided in the upper cover 12. Accordingly, even though the color printer 1 is placed at a low place, a user can cope with paper jams, without bending down, by simply opening the upper cover 12 to a position where the user can visually observe the discharge roller 93.

Further, since positions of the discharge roller 93 are changeable in accordance with angles of the upper cover 12, a user can have a clear look at the area around the discharge roller 93 regardless of vertical positions of the color printer 1 or user's heights. Removal of paper jams is thus performed easily.

Additionally, since the meshing engagement between the cover gear G2 and the main body gear G3 is released while the upper cover 12 is open, a user can pull out the jammed paper P with less strength. Further, the gears G2 and G3 are brought into disengagement one from the other when the upper cover 12 is opened, thereby allowing paper jams to be settled even in case of power failure or power suspension.

Further, the pinch roller 95 is configured to be movable between the press-contact position and the separation position in the color printer 1. With this configuration, the load applied to the paper P can be made even smaller. Moreover, because only one of the two pinch rollers, i.e., the pinch roller 95, is configured to change the position thereof between the press-contact position and the separation position, the degree of paper curl can be adjusted. That is, an extent to which both ends of the paper P in the conveying direction are urged to curl toward a center of the paper P in the conveying direction is allowed to change. More specifically, when the degree of curl is large, both of the pinch rollers 94 and 95 are pressed against the discharge roller 93, while only the pinch roller 95 is kept away from the discharge roller 93 when the degree of curl is small. In this way, the degrees of curl can be suppressed.

Further, as described above, the engagement between the protrusion 133 and the sloped portion 146 enables rightward force imparted on the operation member 140 to convert into force to separate the pinch roller 95 from the discharge roller 93, i.e., force that allows the pinch roller 95 to move from the press-contact position to the separation position, and the converted force is then transmitted to each of the supporting members 100. With this configuration, each pinch roller 95 supported on each of the supporting members 100 is allowed to be brought into contact with or separation from the discharge roller 93 all at a time.

Further, since the left-side end 141 of the operation member 140 is designed to protrude leftward of the plurality of supporting members 100, a user can easily grip the left-side end 141, facilitating operability of the operation member 140.

Further, the main body 10 has the rear wall 10B formed with the opening 10C for exposing the discharge path 91. The rear wall 10B is also provided with the rear cover 10D for covering the opening 10C. This configuration also allows a user to tackle paper jams from the rear side of the main body 1.

Although the present invention has been described with respect to specific embodiments, a variety of changes may be made therein as described below.

In the above embodiment, one pair of pinch rollers 94 and 95 is provided for a single discharge roller 93. However, a single pinch roller may be provided instead vis-a-vis a single discharge roller. In this case, the single pinch roller may be configured to be separated from or pressed against the single discharge roller.

The upper cover gear G2 may not necessarily be provided. That is, the drive gear G1 may be configured to meshingly engage the main body gear G3 directly, not via the upper cover gear G2. In this case as well, the engagement between the drive gear G1 and the main body gear G3 is to be released when the upper cover 12 is opened.

The present invention is applied to the color printer 1 in the above-described embodiment, but may also be applied to other types of image forming devices, such as a multifunctional device and a copier.

In the above embodiment, the paper P is employed as an example of recording sheets including cardboards, postcards, or thin papers. However, transparencies may also be employed.

What is claimed is:

1. An image forming device comprising:

a main body formed with an upper opening;

an image forming unit that forms images on recording medium, the main body accommodating the image forming unit; and an upper cover pivotably movably supported to the main body for covering the upper opening, the upper cover including:

a discharge roller; and a pinch roller that is pressed against the discharge roller, the discharge roller discharging the recording medium conveyed from the image forming unit outside the main body in cooperation with the pinch roller, wherein the upper cover further comprises a drive gear that transmits a driving force to the discharge roller; and wherein the main body further comprises a main body gear that transmits the driving force to the drive gear, the main body gear meshingly engaging the drive gear directly.

2. The image forming device according to claim 1, wherein the drive gear and the main body gear are disengaged from each other when the upper cover is opened.

3. The image forming device according to claim 1, wherein the pinch roller is movable between a press-contact position and a separation position, the press-contact position being a state where the pinch roller is pressed against the discharge roller, and the separation position being a state where the pinch roller is separated from the discharge roller.

4. The image forming device according to claim 1, wherein the main body has a side wall provided with a shaft about which the upper cover pivotably moves, the side wall being formed with a side opening and a side cover that covers the side opening, the side opening exposing a sheet discharge path extending toward the discharge roller and the pinch roller along which the recording medium is discharged.

5. An image forming device comprising:

a main body formed with an upper opening;

an image forming unit that forms images on recording medium, the main body accommodating the image forming unit; and an upper cover pivotably movably supported to the main body for covering the upper opening, the upper cover including:

a discharge roller; and a pinch roller that is pressed against the discharge roller, the discharge roller discharging the recording medium conveyed from the image forming unit outside the main body in cooperation with the pinch roller, wherein the upper cover includes a pair of pinch rollers juxtaposed in a sheet conveying direction for the discharge roller; and wherein one of the pair of discharge rollers, located upstream in the sheet conveying direction, is movable between a press-contact position and a separation position, the press-contact position being a state where the upstream pinch roller is pressed against the discharge roller, and the separation position being a state where the upstream pinch roller is separated from the discharge roller.

6. The image forming device according to claim 5, wherein the upper cover further comprises:

a plurality of pairs of pinch rollers arranged in a widthwise direction of the recording medium orthogonal to the sheet conveying direction;

a plurality of discharge rollers, each being disposed in correspondence with each of the plurality of pairs of pinch rollers;

a plurality of supporting members that rotatably supports each pair of pinch rollers;

an operation member extending in the widthwise direction; and a cam mechanism that converts a first force to a second force and transmits the second force to each of the supporting members, the first force being imparted on the operation member in the widthwise direction by a user, the second force enabling each of the upstream pinch rollers to move between the press-contact position and the separation position.

7. The image forming device according to claim 6, wherein the operation member has an end portion protruding outward in the widthwise direction, the plurality of supporting members being located inward of the end portion with respect to the widthwise direction.

8. The image forming device according to claim 6, wherein the cam mechanism comprises a cam groove formed in the operation member and a connection member connecting each of the supporting members.

9. The image forming device according to claim 8, wherein the cam groove further comprises a first groove and a second groove, the first groove having a height smaller than that of the second groove; and wherein the plurality of upstream pinch rollers moves between the press-contact position and the separation position when the connection member moves between the first groove and the second groove.

10. The image forming device according to claim 9, wherein the plurality of upstream pinch rollers is at the separation position when the first groove engages the connection member, and the plurality of upstream pinch rollers is at the press-contact position when the second groove engages the connection member.

* * * * *